US005402214A

United States Patent [19]

Henderson

[11] Patent Number: 5,402,214

[45] Date of Patent: Mar. 28, 1995

[54] TONER CONCENTRATION SENSING SYSTEM FOR AN ELECTROPHOTOGRAPHIC PRINTER

[75] Inventor: Thomas A. Henderson, Rochester, N.Y.

[73] Assignee: Xerox Corporation, Stamford, Conn.

[21] Appl. No.: 200,594

[22] Filed: Feb. 23, 1994

[51] Int. Cl.[6] ..... G03G 21/00

[52] U.S. Cl. ..... 355/246; 118/689; 355/208

[58] Field of Search ..... 355/203, 208, 246, 214; 118/689–691

[56] References Cited

U.S. PATENT DOCUMENTS

| | | | |
|---|---|---|---|
| 3,575,505 | 4/1971 | Parmigiani | 355/246 |
| 4,272,182 | 6/1981 | Abe et al. | 355/246 |
| 4,318,610 | 3/1982 | Grace | 355/246 |
| 4,419,010 | 12/1983 | Grombone et al. | 355/133 |
| 4,434,221 | 2/1984 | Oka | 430/122 |
| 4,492,179 | 1/1985 | Folkins et al. | 118/689 |
| 4,514,480 | 4/1985 | Wada et al. | 430/30 |
| 4,786,924 | 11/1988 | Folkins | 355/208 |
| 4,829,336 | 5/1989 | Champion et al. | 355/246 |
| 4,879,577 | 11/1989 | Mabrouk et al. | 355/208 |
| 5,034,775 | 7/1991 | Folkins | 355/259 |
| 5,150,135 | 9/1992 | Casey et al. | 346/159 |
| 5,210,572 | 5/1993 | MacDonald et al. | 355/208 |
| 5,214,476 | 5/1993 | Nomura et al. | 355/246 |

FOREIGN PATENT DOCUMENTS

| | | | |
|---|---|---|---|
| 3-91773 | 4/1991 | Japan | 355/246 |
| 5-19630 | 1/1993 | Japan | 355/246 |

*Primary Examiner*—William J. Royer
*Attorney, Agent, or Firm*—R. Hutter

[57] ABSTRACT

A system controls the concentration of toner in developer in an electrophotographic printer. Toner is applied on a test patch on a charge-retentive surface in a manner consistent with a desired toner density on a test patch, and the actual toner density on the test patch is measured. The charge applied to the charge-retentive surface is then adjusted in response to the measured actual toner density to obtain the desired toner density on a subsequent test patch. The change in charge applied to the charge-retentive surface is used to detect a shortage of toner in the developer.

6 Claims, 3 Drawing Sheets

TONER CONCENTRATION SENSING SYSTEM FOR AN ELECTROPHOTOGRAPHIC PRINTER

The present invention relates to a system for determining the concentration of toner within the developer mixture in an electrophotographic printer. The system of the present invention allows such a measurement to be made without direct physical testing of a developer, but rather by inferring the toner concentration by observing changes in other parameters in the system.

In the well-known process of electrophotographic printing, also known as "xerography," a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finally divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate, such as paper, and the image affixed thereto to form a permanent record of the image to be reproduced.

The step in the electrophotographic process in which the toner is applied to the latent image is known as "development." In any development system, a quantity of toner is brought generally into contact with the latent image, so that the toner particles will adhere or not adhere to various areas on the surface in conformity with the latent image. Many techniques for carrying out this development are known in the art. A number of such techniques require that the toner particles be evenly mixed with a quantity of "carrier." Generally speaking, toner plus carrier equals "developer." Typically, toner particles are extremely fine, and responsive to electric fields; carrier particles are relatively large and respond to magnetic fields. In a "magnetic brush" development system, the developer is exposed to relatively strong magnetic fields, causing the carrier particles to form brush-like strands, much in the manner of iron filings when exposed to a magnetic field. The toner particles, in turn, are triboelectrically adhered to the carrier particles in the strands. What is thus formed is a brush of magnetic particles with toner particles adhering to the strands of the brush. This brush can be brought in contact with the latent image, and under certain conditions the toner particles will separate from the carrier particles and adhere as necessary to the photoreceptor.

An important process parameter for any development system is the ratio of toner particles to carrier within the developer. It is also expectable that, in the course of use of the printer, the toner to carrier (T/C) ratio will change significantly as toner particles are transferred from the developer supply to the photoreceptor and ultimately to print sheets. There have thus been numerous systems devised in the prior art for determining and controlling this T/C ratio in an operating machine. Because carrier particles are generally heavy and magnetic, while toner particles are generally light and non-magnetic, many of these systems involve detecting the behavior of magnetic flux through the developer; placing a quantity of developer between capacitor plates and examining the electrical behavior thereof; or electrically drawing a quantity of toner from the developer and inferring a T/C therefrom. However, very often such systems have proven to be either inaccurate, imprecise, or too expensive for use in inexpensive printers and copiers.

U.S. Pat. No. 4,272,182 discloses a system for controlling image density by maintaining a fixed, predetermined image-developing bias voltage during development of a reference patch. This patent discloses a connection between a test patch photosensor and a toner supply apparatus. However, the system further discloses control of the bias voltage between the developer housing and the charge-retentive surface, but not the initial charging voltage prior to the developing step.

U.S. Pat. No. 4,318,610 discloses a density-control apparatus wherein a first test area and a second test area are recorded on a photoreceptor, with the first test area being denser than the second test area. Concentration of toner particles within the developer is controlled in response to the detected density of the first test area, and the charge on the photoreceptor is regulated in response to the density of the second test area.

U.S. Pat. No. 4,419,010 discloses a method for controlling toner concentration by use of a patch sensor. The test patch is toned while the voltage on the charge-retentive surface is substantially zero, and while the developing field is provided by a voltage source having a polarity opposite that which is used during reproduction.

U.S. Pat. No. 4,434,221 discloses a toner concentration detection and control method in which part of a photoreceptor, in a non-image region thereof, is used as a "carrier adhering region." Magnetic carrier is caused to adhere to the carrier adhering region, while simultaneously current flowing between the developing electrode and the photoreceptor is measured, to control the replenishing amount of toner with respect to the developer.

U.S. Pat. No. 4,492,179 discloses a control system wherein, as toner particles are deposited on the latent image, the charge on the developer roller is sensed. In response to the sensed charge of the toner particles, additional marking particles are dispensed into the chamber of the housing.

U.S. Pat. No. 4,786,924 discloses a control system wherein the electrical current biasing a developer roll is measured to yield a control signal which controls the discharging of marking particles. Periodically this control signal is adjusted as a function of a detected image density of a test patch.

U.S. Pat. No. 4,514,480 discloses a toner concentration control system wherein the amount of magnetic carrier particles adhering to the photosensitive surface is measured, and then the toner in the developer supply is replenished according to the amount of carrier particles detected.

U.S. Pat. No. 4,829,336 discloses a toner concentration system particularly directed to testing multiple levels of toner coverage, such as "gray" and "black." The patent discloses manipulation of one "development vector" (potential difference in the photoreceptor) for optimizing gray development, while holding the development vector for black development constant. The patent discloses changing the initial charge voltage of the photoreceptor as a means of changing the development vector. In this patent the preferred method for correcting for a desired image density is to first change the concentration of toner within the developer station, and then to change the magnitude of the development field in order to adapt to the new toner concentration.

U.S. Pat. No. 4,879,577 discloses a system for controlling the electrostatic parameters of a development system, particularly as relating to a "saturation voltage" of the photoreceptor.

U.S. Pat. No. 5,034,775 discloses a control system in which the instantaneous triboelectric charge of the developer material is measured by integrating a measured current flow electrically biasing the donor roll from which toner particles are transferred to the photoreceptor.

U.S. Pat. No. 5,150,135 discloses an ionographic printing device in which, during deposition of marking particles on the latent image, the charge on the particles is sensed. In response to the sensed charge, additional toner particles are dispensed into the housing. Periodically, the actual concentration of toner particles within the developer is measured, and in response, the rate at which toner particles are replenished in the developer is modified to maintain an equilibrium concentration of toner within the developer.

U.S. Pat. No. 5,210,572 discloses a control system wherein densitometer readings of developed toner patches in a multi-color imaging apparatus are compared to target values stored in a memory and are compared to a previous densitometer reading. The densitometer readings are examined as to how far the reading is from a target value, and also as to the current trend of the actual measured density relative to the target. In this way, the rate of replenishment of the developer with toner is controlled.

U.S. Pat. No. 5,214,476 discloses a development system wherein the toner concentration is directly sensed by a magnetic sensor. The rate of introducing new toner into the developer housing is controlled in accordance with a fuzzy-logic inference based on the current output of the magnetic sensor and the change rate of the magnetic sensor.

According to the present invention, there is provided a method of controlling toner concentration in a quantity of developer material used in an electrophotographic printer wherein toner is applied to an electrostatic latent image on a charge-retentive surface. An initial charge is placed on the charge-retentive surface, and the surface imagewise discharged. Toner is applied on a test patch on the charge-retentive surface in a manner consistent with a desired toner density on a test patch, and the actual toner density on the test patch is measured. The development field is then changed in response to the measured actual toner density to obtain the desired toner density on a subsequent test patch. In response to the magnitude of the development field being changed to exceed a predetermined amount, a quantity of toner is added to the quantity of developer material.

Figure 1:
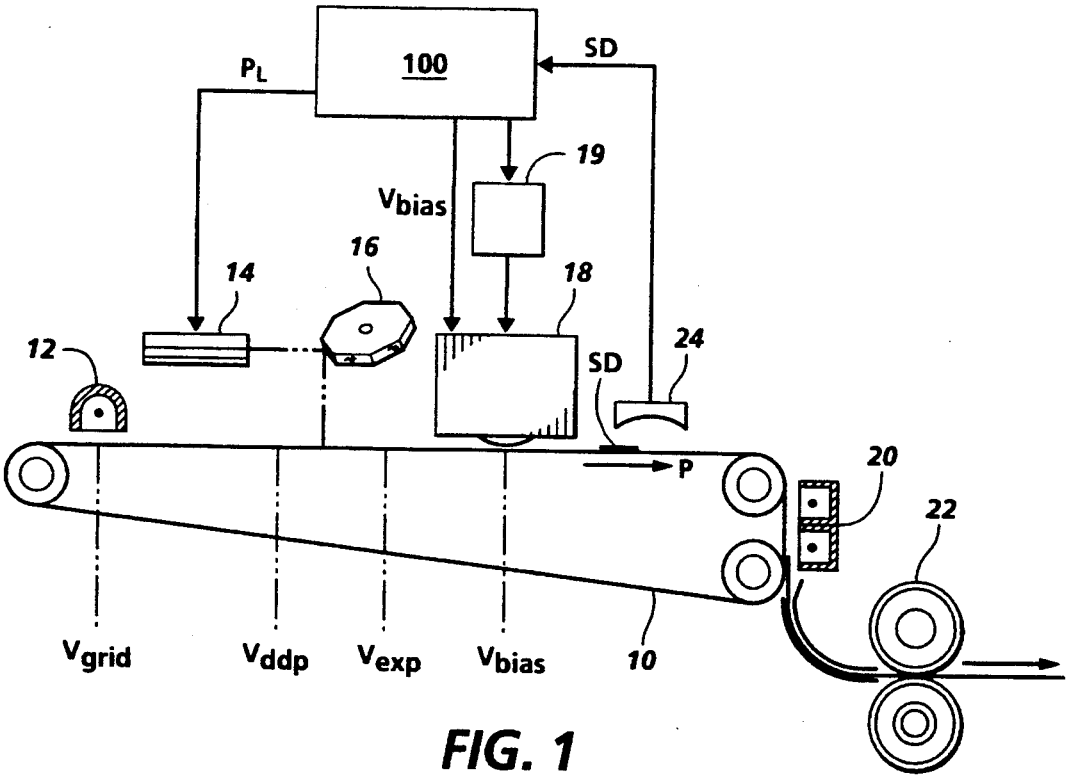
FIG. 1 is a simplified elevational view of the basic elements of an electrophotographic printer.

FIG. 1 shows the basic elements of the well-known system by which an electrophotographic printer, such as a copier or a "laser printer," creates a dry-toner image on plain paper. There is provided in the printer a photoreceptor 10, which may be in the form of a belt or drum, and which comprises a charge-retentive surface. The photoreceptor 10 is here entrained on a set of rollers and caused to move through process direction P. Moving from left to right in FIG. 1, there is illustrated the basic series of steps by which an electrostatic latent image according to a desired image to be printed is created on the photoreceptor 10, how this latent image is subsequently developed with dry toner, and how the developed image is transferred to a sheet of plain paper. The first step in the electrophotographic process is the general charging of the relevant photoreceptor surface. As seen at the far left of FIG. 1, this initial charging is performed by a charge source known as a "scorotron," indicated as 12. The scorotron 12 typically includes an ion-generating structure, such as a hot wire, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises a laser source 14 and a rotatable mirror 16 which act together, in a manner known in the art, to discharge certain areas of the charged photoreceptor 10. Although the Figure shows a laser source to selectively discharge the charge-retentive surface, other apparatus that can be used for this purpose include an LED bar, or, in a copier, a light-lens system. The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10. The laser source 14 outputs a laser beam having a specific power level, here shown as PL, associated therewith.

After certain areas of the photoreceptor 10 are discharged by the laser source 14, the remaining charged areas are developed by a developer unit such as 18 causing a supply of dry toner to contact the surface of photoreceptor 10. The developed image is then advanced, by the motion of photoreceptor 10, to a transfer station including a transfer scorotron such as 20, which causes the toner adhering to the photoreceptor 10 to be electrically transferred to a print sheet, which is typically a sheet of plain paper, to form the image thereon. The sheet of plain paper, with the toner image thereon, is then passed through a fuser 22, which causes the toner to melt, or fuse, into the sheet of paper to create the permanent image. Some of the system elements of the printer shown in FIG. 1 are controlled by a control system 100, the operation of which will be described in detail below.

Figure 2:
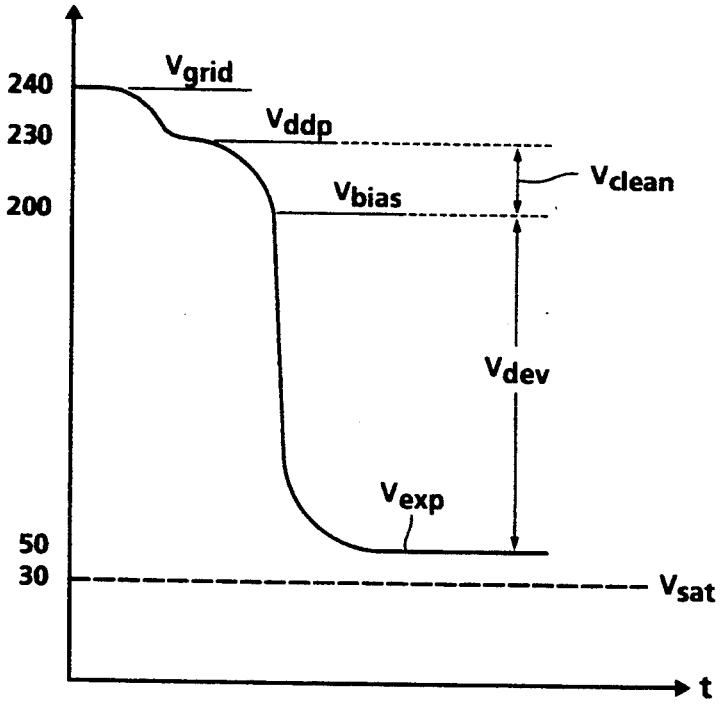
FIG. 2 PRIOR ART
FIG. 2 is a graph showing the relative potentials on a portion of a charge-retentive surface in an electrophotographic printer as it passes through a variety of stations.

Looking now at FIG. 2 and with continuing reference to FIG. 1, the electrostatic "history" of the representative small area on the photoreceptor 10 as it moves through the various stations in the electrophotographic process is described in detail. Here, the charge on the particular area of photoreceptor 10 is expressed in terms of an electrostatic potential (voltage) on that particular area of the surface. Starting with the initial charging of the surface by scorotron 12, an initial high potential $V_{grid}$ is placed on the given area; in this example $V_{grid}$ is +240 volts, but this is by way of example and not of limitation. As used in the claims herein, an "initial" charge shall be defined as the charge placed on the photoreceptor or charge-retentive surface prior to the development step, as opposed to any charge incidentally applied to the charge-retentive surface during or as a result of the developing step. Once an initial charge is placed on photoreceptor 10, this charge begins to decay immediately, to the extent that, by the time the representative area reaches the ROS, the potential is slightly decreased to a "dark decay potential," or $V_{ddp}$, in this example to 230 volts. At the exposure step, if the particular area in question is to be discharged by the action of the laser 14, the potential on that particular area will be markedly reduced, in this example to a value of $V_{exp}$ of 50 volts, which is low enough to ensure that toner will be attracted thereto, particularly relative to highly charged areas thereon.

Also associated with a system such as this is a bias voltage, $V_{bias}$, which is the voltage applied to a relevant portion of the development unit, such as for example the housing thereof or a roll therein. The difference between the dark decay potential $V_{ddp}$ and the bias voltage $V_{bias}$ is known as the "cleaning voltage" $V_{clean}$, a value which is relevant to the amount of background development in the system. More significantly, development voltage $V_{dev}$, as shown in the graph of FIG. 2, is the difference between the bias voltage $V_{bias}$ and the exposure voltage $V_{exp}$. $V_{dev}$ thus represents the charge difference which drives the movement of toner to the photoreceptor; as such, $V_{dev}$ is the parameter of most direct relevance to the maintenance of a satisfactory solid area density SD.

Another important parameter in an electrophotographic printer is the "saturation" voltage $V_{sat}$, which is the theoretical maximum possible discharge when the laser source 14 is operating at full power. In the present example, $V_{sat}$ is 30 volts, which is to say that it is generally impossible for a laser of any practical strength to discharge a photoreceptor completely. The value of $V_{sat}$ is generally dependent on the nature of the photoreceptor 10 itself, and the maximum output of the particular laser 14 in the system has a generally asymptotic effect on the value of $V_{sat}$. In many instances, the value of $V_{sat}$ may be considered a constant, because even a great increase in the power of laser source 14 will not have a substantial effect on the value of $V_{sat}$.

As shown in FIG. 1, a densitometer generally indicated as 24 may be used after the developing step to measure the optical density of a solid-density test patch (marked SD) created on the photoreceptor 10 in a manner known in the art. Typically such test patches are created in interdocument zones between image pitches on the photoreceptor, and are placed in known locations where they may be tested by a densitometer in a fixed position after the test patches are developed. In a laser printer, such test patches may be created by specific routines for controlling the laser 14 and rotatable mirror 16, as is known in the art. In the preferred embodiment of the present invention, the system output which is of most interest is the solid area density (SD) test patch, as will be explained in detail below.

Figure 3:
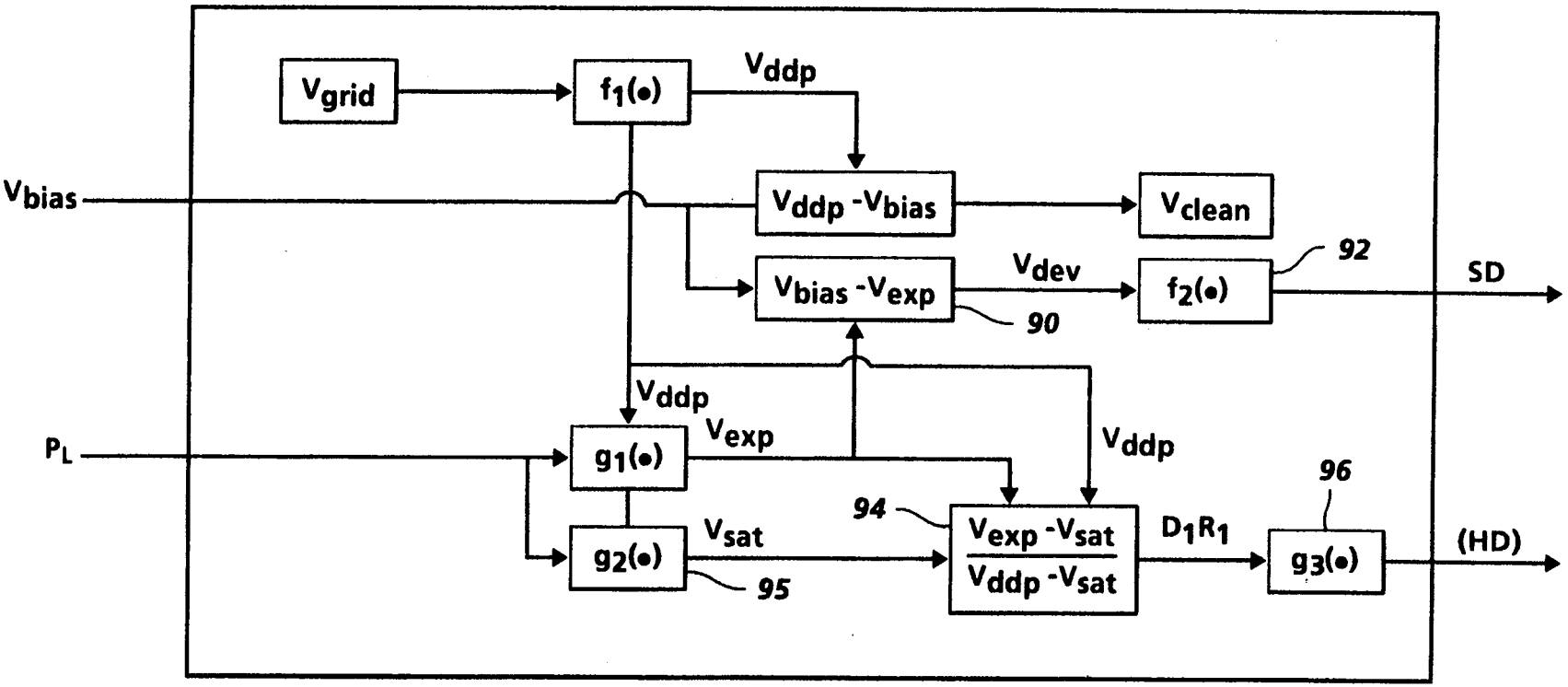
FIG. 3 PRIOR ART
FIG. 3 is a systems diagram showing the interrelationship of various functions and potentials within the representative electrophotographic printer of FIG. 1.

FIG. 3 is a systems diagram showing the basic interactions among the various potentials that are relevant to the electrophotographic process, here organized into a single "black box" indicated as 99, with the relevant inputs and outputs being limited to those outputs which may be readily measured, and those inputs which may be readily controlled. In the diagram it may be seen that certain relationships between relevant potentials are neatly mathematically related, while more subtle or complicated relationships, such as the relationship of $V_{grid}$ to $V_{ddp}$, are shown as empirical relationships such as $F_1$, $F_2$, $g_1$, $g_2$, and $g_3$. Certain relationships of interest that may be seen in FIG. 3 include the fact that $V_{bias}$ is typically of a fixed relationship with $V_{grid}$ and that another relevant potential is the development voltage $V_{dev}$, which is the difference between $V_{bias}$ and $V_{exp}$, shown at the box indicated as 90, and which has been shown to have an empirical relationship, through a function $F_2$ in box 92, to the solid area density SD. (Also shown in FIG. 3 is the concept of the "discharge ratio," shown at box 94 which is theorized to have a highly correlative relationship, such as through a function $g_3$ in box 96, to a halftone density HD, which is not directly relevant to the present discussion. This discharge ratio indicated in box 94 is given as a ratio which takes into account the saturation voltage $V_{sat}$ of the particular photoreceptor, which, incidentally, is also related somewhat to the laser power $P_L$ by a relationship $g_2$ indicated in box 95, although the value of $V_{sat}$ has been found to be substantially constant for a given apparatus.)

In the system according to the present invention, the development field $V_{dev}$ required to maintain a solid area density SD is used as the guide to determine when to add toner to the developer to increase the T/C. For systems relying on "discharged-area development," also known as DAD, an example of which is shown in the illustrated embodiments, the photoreceptor surface is charged with an initial charge, and the function of the laser source 14 is to remove this initial charge from areas in which print-black areas of the image are intended. In such a situation, the developer unit 18 is so designed to cause toner particles to adhere to the discharged areas of the photoreceptor, the charge areas of the photoreceptor repelling the toner particles. The magnitude of the development field $V_{dev}$ can be increased by either increasing the discharging power of the laser source 14, which in turn will cause a greater decrease in $V_{exp}$, or alternately increasing the value of $V_{bias}$, which is the voltage associated with the developer housing 18 (or a relevant part thereof). Thus, looking at the "black box" configuration of relationships in FIG. 3, the two relatively easily controlled physical parameters which can serve as inputs are $V_{bias}$, the bias of the development unit 18, and $P_L$, the power associated with the laser source 14. Returning to FIG. 1, the black box controller 100 accepts as an input the feedback of actual solid-area density SD, and in turn outputs controls for $P_L$ to laser source 14, and $V_{bias}$ to development unit 18.

It should also be noted that the control system could be modified for electrophotographic systems which rely on "charged-area development," or CAD. In CAD systems, the laser source 14 is used to leave a charge on the areas of the photoreceptor which are intended to be developed with toner, the toner particles in the development unit 18 being so charged as to be attracted to the charged areas on the photoreceptor 10. In the CAD case, the value of $V_{dev}$ can be increased either by raising the photoreceptor charge or reducing the value of $V_{bias}$ on the developer roll 18. However, whether in a DAD or a CAD system, the claimed principle of the present invention, increasing the value of the development field $V_{dev}$, is the same.

As used in the claims herein, the phrase "development field" shall be defined as the difference in voltage between the area of the photoreceptor that is to receive toner and the developer unit (or relevant portion thereof) donating that toner. This definition applies to either the charged-area development or discharged-area development case.

In the illustrated embodiment of the system of the present invention, particularly as relating to FIG. 2 herein, there is a convention that the arrangement of voltages are all positive. However, it would be apparent to one of skill in the art, that an equivalent system could be designed according to the present invention, wherein negative voltages are applied to the photoreceptor, and in the course of exposure and development the series of voltages in FIG. 2 would "rise" toward a zero value. However, for purposes of clarity, only the positive voltage is described and illustrated.

Referring again to FIG. 1, densitometer 24 is disposed along the path of photoreceptor 10 so as to detect the actual toner density of a test patch shown as SD, which is intended to have the maximum practical solid area density of toner that can be placed on a normally-charged photoreceptor. Systems for measuring the true optical density of a test patch are shown in, for example, U.S. Pat. No. 4,989,985 or U.S. Pat. No. 5,204,538, both assigned to the assignee hereof and incorporated by reference herein. Densitometer 24, through means known in the art, should detect a density in solid area test patch SD which is consistent with this maximum practical density of toner on the photoreceptor 10; if the densitometer 24 detects less than the maximum practical density of toner, a corrective action by controller 100 will therefore be necessary to increase the toner density in the next or subsequent solid area test patch. As noted above, the most important process parameter for optimizing the density of a solid-area test patch is to adjust (typically, increase) the value of $V_{dev}$.

Controller 100, as shown in FIG. 1, is intended to accept as an input the reading of the solid area density SD from densitometer 24, and as an output is adapted to control $V_{dev}$ (by controlling $V_{bias}$ and/or $P_L$) and also a toner supply 19 for the developer unit 18. In controlling $V_{dev}$ and the behavior of the toner supply 19, the controller exploits short term and long term solutions for maintaining solid area density. $V_{dev}$ can thus be changed relatively easily, and conceivably adjusted either upward or downward for an optimal value of SD. However, it follows that the progressive degradation of solid area density as the toner supply is used up within the developer can be cured only to an extent by increasing $V_{dev}$. Eventually, the decreasing T/C ratio must be counteracted by directly adding more toner to the developer.

Figure 4:
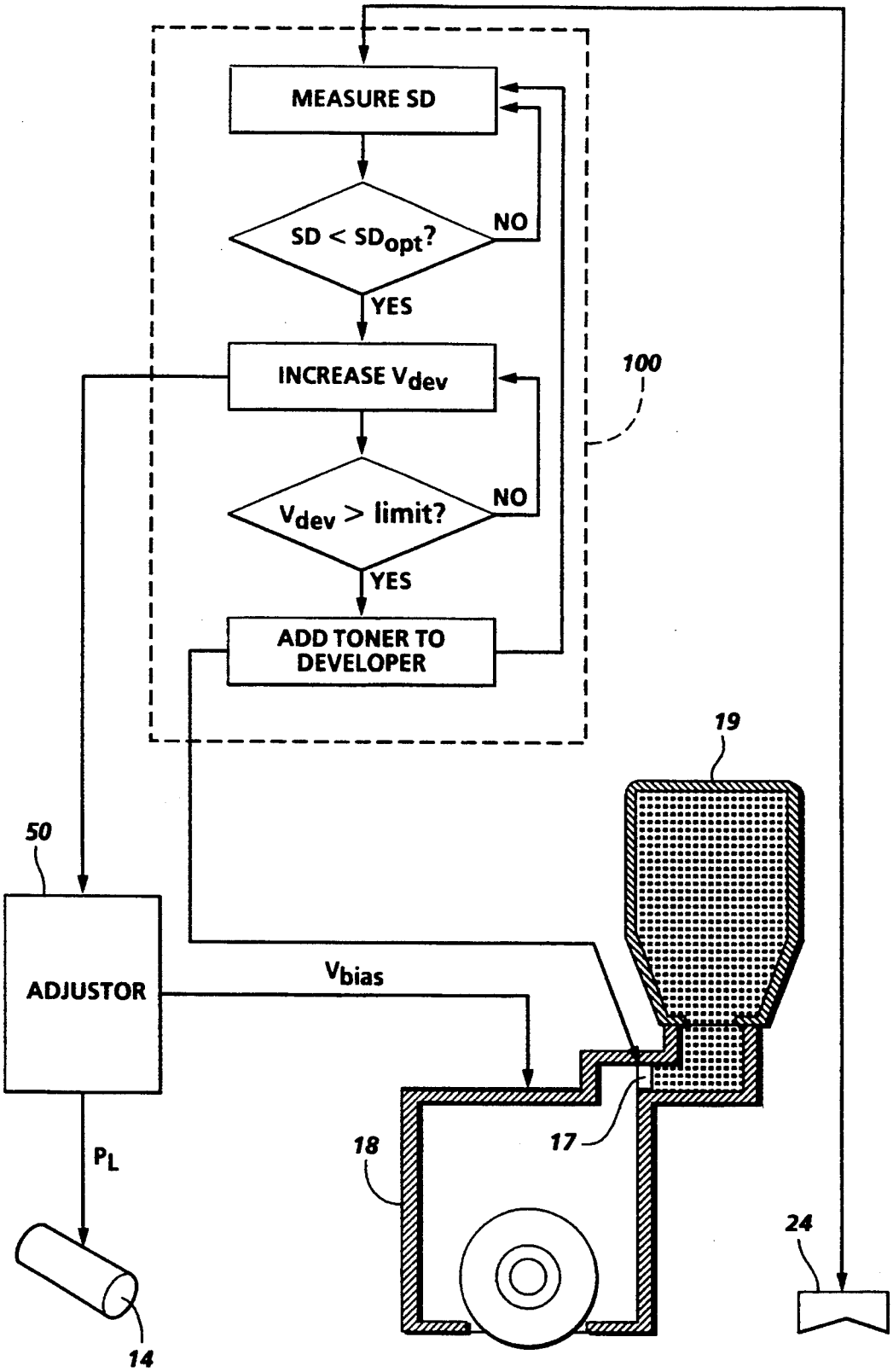
FIG. 4 is a systems diagram, incorporating a flowchart, illustrating the operation of a system according to the present invention.

In the system of the present invention, the increasing $V_{dev}$ required to maintain the solid area density SD at a desired level is used as a device either to measure by inference the T/C of the developer at a given moment, or more simply as a trigger to detect a condition of insufficient toner in the developer. FIG. 4 is a diagram comprising a flow-chart, describing the control behavior of controller 100 in detail. As would be apparent to one skilled in the art, the flow-chart shown within controller 100 could be embodied readily by a microprocessor program, reflecting empirically-collected data about the particular type of apparatus being controlled, or conceivably by means of an analog computer or other control circuit. As can be seen in the flow-chart, the essential function of controller 100 comprises two polling loops. A first loop monitors the solid area density SD from densitometer 24 and compares this reading to a predetermined optimum density $SD_{opt}$. As can be seen in FIG. 4, whenever the measured value of SD is even slightly below the optimum, the controller 100 causes the $V_{dev}$ to be increased by a predetermined amount, the actual value of the predetermined amount being a matter of design choice depending on the desired responsivity of the control system. The second polling loop within controller 100 monitors the actual value of $V_{dev}$ over time. Because of the constraints of the system, it is reasonable to infer that an increase in necessary $V_{dev}$ is the result of a corresponding decrease in T/C, all other parameters being equal. Thus, it is possible to infer a reasonably accurate value of T/C from the necessary value of $V_{dev}$. For a particular electrophotographic printer, this relationship could be determined empirically. However, it may not be necessary for the actual value of T/C to be calculated in real time. More likely, all that will be necessary is that a condition of too-low T/C will be inferred when $V_{dev}$ exceeds a predetermined "trigger" level.

As can be seen in FIG. 4, once there is a need, determined by controller 100, to increase the value of $V_{dev}$ in a DAD system, there are two possible physical options: to increase either the value of $V_{bias}$ on the development unit 18, or decrease the value of $D_{exp}$ by increasing the power of the laser device 14, hereshown as $P_L$. Since the object of the controller 100 is to increase the difference between $V_{bias}$ and $V_{exp}$, it is conceivable that one or the other, or both, of these parameters can be adjusted. In practice, to what extent either of these parameters are adjusted in absolute terms depends on the specific design of a printer. For example, certain laser diodes may not be readily linearly controllable to output a desired laser power, in which case control of $V_{bias}$ to development unit 18 would provide more control. There is shown in FIG. 4 an adjustor 50, a circuit which, depending on the specific design of the printer, will control either $V_{bias}$ or $P_L$ to various extents in order to obtain a desired value of $V_{dev}$. Once again, in the illustrated embodiments is shown only a DAD system; it would be apparent to one skilled in the art that in an equivalent CAD system, the value of $V_{dev}$ is increased either by raising the photoreceptor charge (such as by increasing the charging power of an initial $V_{grid}$, or by decreasing (as opposed to increasing) the value of $V_{bias}$.

In physical terms, the higher the $V_{dev}$, the more readily toner particles will adhere to the desired areas of photoreceptor 10. However, if there is a paucity of available toner particles within the developer, increases in $V_{dev}$ will have decreasing marginal returns in causing more of these particles to adhere to the photoreceptor in order to maintain a constant SD. At this point, the only solution for maintaining the desired SD is to enrich the developer with a fresh addition of new toner.

For the purpose of increasing the toner supply to the developer in unit 18, controller 100 can be adapted to activate a mechanical device such as 17 to cause the admission of more toner such as from hopper 19, into the main developer supply in development unit 18. Numerous schemes for introducing toner as needed into a developer unit 18 are known in the art. Mechanical device 17 could be an openable hatch activated by a solenoid, an auger caused to rotate, or any such mechanical means that are known in the art. The actual toner supply from hopper 19 may, according to the design of the particular machine, comprise pure toner from a bottle, or may comprise some quantity of carrier particles as well. What is important for the present invention is that the introduction of toner or toner-rich developer from hopper 19 substantially increases the T/C of the general developer supply in developer unit 18 from which toner is taken to be applied to the latent image on the photoreceptor.

With an enriched developer in the developer unit 18, there will thus be a greater supply of toner particles available within the developer unit 18 to adhere to photoreceptor 10. Because of this greater supply, it will be easier to provide sufficient toner coverage on the photoreceptor to obtain an optimal measured SD at densitometer 24. For this reason, with the newly-enriched developer, a lower value of $V_{dev}$ will be necessary to cause the amount of toner to adhere to the photoreceptor. Thus, after the toner supply is replenished, the value of $V_{dev}$ can return to a relatively low value by the increase in solid density due to the toner dipense, and then subsequently allowed to gradually increase until the next cycle wherein the value of $V_{dev}$ that triggers further introduction of toner into the developer unit 18.

In brief, the control system of the present invention employs a "fine tuning" of print quality in the form of short-term variations in the $V_{dev}$, and a broader, longer-term print quality adjustment in introducing more toner into the developer supply when the value of $V_{grid}$ reaches a predetermined trigger point. A key advantage of this system is that the value of T/C need never be directly measured; rather, the value of T/C is reasonably accurately inferred from the necessary value of $V_{dev}$ required to maintain a desired value of SD. Because the value of T/C need never be directly measured, the necessity for a toner concentration device is obviated. As such devices have been shown by experience to be expensive and/or inaccurate, this relatively easily embodied system can represent a major cost saving in the design of a machine.

The basic simplicity of the system of the present invention is particularly advantageous for low-end machines. The fine-tuning aspect of the system, wherein a low detected density is "answered" with an increase in $V_{dev}$, can be carried out with a very simple circuit; and similarly the "trigger" value of $V_{dev}$ can be used to cause more toner to be introduced into the developer housing, possibly without even the use of a central processor. Further, because the system does not need to measure directly either the T/C ratio or any charge associated with the development step, not only does the system avoid the expense of making such measurements, fewer sources of noise are introduced into the system. The system can thus be incorporated in a copier or printer with very low added cost, particularly in comparison with other prior-art systems.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A method of controlling toner concentration in a quantity of developer material used in an electrophotographic printer including means for applying toner to an electrostatic latent image on a charge-retentive surface by creating an electrostatic development field of a preselected magnitude, comprising the steps of:

creating an electrostatic charge of predetermined magnitude on an area of the charge-retentive surface, therby creating a test patch in the area;

electrostatically applying toner in a manner consistent with a desired toner density on the test patch;

measuring the actual toner density on the test patch to indicate a measured toner density;

changing the magnitude of the development field in response to the measured toner density, to obtain the desired toner density on a subsequent test patch; and causing a quantity of toner to be added to the quantity of developer material in response to the development field being changed to exceed a predetermined magnitude.

2. The method of claim 1, wherein the applying step comprises applying a substantially maximum toner density on the charge-retentive surface.

3. The method of claim 1, wherein the step of changing the magnitude of the development field does not require directly measuring the magnitude of the development field.

4. A system for controlling toner concentration in a quantity of developer material used in an electrophotographic printer including means for applying toner to an electrostatic latent image on a charge-retentive surface, comprising:

means for applying an initial charge to the charge-retentive surface;

means for creating a electrostatic charge of predetermined magnitude on an area of the charge-retentive surface, therby creating a test patch in the area;

means for electrostatically applying toner in a manner consistent with a desired toner density on the test patch, said means for electrostatically applying toner creating an electrostatic development field of a preselected magnitude;

means for measuring the toner density on the test patch to indicate a measured toner density;

means for changing the magnitude of the electrostatic development field in response to the measured toner density, to obtain the desired toner density on a subsequent test patch; and means for causing a quantity of toner to be added to the quantity of developer material in response to the magnitude of the electrostatic development field being changed to exceed a predetermined magnitude.

5. The system of claim 4, wherein the applying means applies a substantially maximum toner density on the charge-retentive surface.

6. The system of claim 4, wherein the means for changing the magnitude of the electrostatic development field does not require directly measuring the magnitude of the electrostatic development field.

* * * * *